US011250682B1

(12) United States Patent
Crawford

(10) Patent No.: US 11,250,682 B1
(45) Date of Patent: Feb. 15, 2022

(54) PROXIMITY AWARENESS PERSONAL ALERT SYSTEM

(71) Applicant: Deanna Crawford, Anchorage, AK (US)

(72) Inventor: Deanna Crawford, Anchorage, AK (US)

( * ) Notice: Subject to any disclaimer, the term of this patent is extended or adjusted under 35 U.S.C. 154(b) by 0 days.

(21) Appl. No.: 17/241,592

(22) Filed: Apr. 27, 2021

(51) Int. Cl.
*G08B 21/02* (2006.01)

(52) U.S. Cl.
CPC ..... *G08B 21/0205* (2013.01); *G08B 21/0288* (2013.01); *G08B 21/0294* (2013.01)

(58) Field of Classification Search
CPC ..... G08B 21/0205
See application file for complete search history.

(56) References Cited

U.S. PATENT DOCUMENTS

2003/0218539 A1* 11/2003 Hight ..... G08B 21/0266 340/539.13
2014/0125479 A1* 5/2014 Schmidt ..... G08B 25/016 340/539.11
2014/0218537 A1* 8/2014 Nepo ..... G08B 25/009 348/158
2015/0002293 A1* 1/2015 Nepo ..... A61K 9/703 340/539.13
2016/0180697 A1* 6/2016 Ros ..... G08B 25/016 340/539.11
2016/0321901 A1* 11/2016 Desoyza ..... A61B 5/0077
2016/0330593 A1* 11/2016 Caperell ..... H04W 4/023
2017/0103635 A1* 4/2017 Kroll ..... G08B 21/0202
2017/0169688 A1* 6/2017 Britt ..... G08B 21/0453
2017/0337795 A1* 11/2017 Harrison ..... G08B 21/0283
2019/0051132 A1* 2/2019 Shepard ..... G08B 21/0275
2019/0156643 A1* 5/2019 Quilter ..... G08B 21/0227
2020/0074838 A1* 3/2020 Yalamachili ..... G08B 21/0216
2020/0098247 A1* 3/2020 Moore ..... G08B 21/0288

* cited by examiner

*Primary Examiner* — Travis R Hunnings
(74) *Attorney, Agent, or Firm* — Michael J. Tavella

(57) ABSTRACT

A system that provides an alarm or alert system for those that cannot communicate, or to notify another party when in a situation that needs immediate attention. It consists of a caregiver band, and at least one dependent band. The dependent bands have an infant size as well. The caregiver band has a transceiver that communicates with the dependent bands. The dependent band has a transceiver as well. The infant band has only a receiver. The caregiver and dependent bands each have a debossed button that when depressed sends a signal to the dependent band(s). This signal has a loud alarm, a flashing LED light and a vibration. To turn off the alarm, the caregiver can press the debossed button a second time, or, as sensor in the bands will shut off the alarm when the bands touch. In one model, an app for use with smartphones is also available.

14 Claims, 20 Drawing Sheets

PROXIMITY AWARENESS PERSONAL ALERT SYSTEM

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to personal proximity awareness alert systems and particularly to personal proximity awareness alert systems for those that cannot communicate, or to notify another party when in a situation that needs immediate attention.

2. Description of the Prior Art

Lost children have been a problem since parents and children have existed. However, unlike the past, we now have technology that can help find them. Moreover, there are adults that have communications difficulties and lack the ability to report their location if lost, e. g., out of sight of a caregiver. In such situations, it is important for parents and caregivers to be able to locate the lost individuals quickly and easily. To that end several patents have been developed in that regard.

So called baby monitors use a microphone in a nursery or other location to listen for noises coming from that room that can alert a parent, babysitter or other caregiver of a problem. One such example is U.S. Pat. No. 5,512,880 that teaches a wristwatch style receiver that can be worn or clipped to a person, as well as being held in a cradle. This is basically a receiver only. U. S. Publication 2012/0326875 teaches an invisible fence for a child. This system involves a monitor station or stations placed at strategic locations. The child wears a second monitor that causes an alarm if the child passes beyond a certain boundary. While somewhat helpful, it does nothing to track the child once the barrier is crossed. U.S. Pat. No. 6,043,747 teaches a standard baby monitor that has a radio transmitter and receiver that not only monitors the baby but can also send soothing messages to the baby. U.S. Pat. No. 10,650,675 teaches a smart wearable device that uses a GPS tracking system to monitor the user's location, and to track that person. It also has a system in which the user can send the user's status back to the monitor. U. S. Publication No. 2008/0055072 teaches a child locator that uses watches by which parents and children can send alarms and can communicate directly if desired. The alarm can be set at various distances. U. S. Publication No. 2015/0109126 teaches a child monitoring system that uses GPS and has microphones, alarms and speakers. The child's unit can also have a camera. U. S. Publication No. 2019/0076091 teaches a baby monitor watch that also has a vital sign monitor. U.S. Pat. No. 5,841,352 teaches a system using a pair of watch-like devices. These devices communicate and have signal strength monitors in them. If the signal between them diminishes to a certain level, indicating that the two units have reached a designated separation, an alarm sounds. In addition, a panic button is provided that can set off the alarm at any time. U.S. Pat. No. 7,259,671 teaches a proximity aware personal alert system that uses a BLUETOOTH link to connect two devices. If the devices move beyond the proscribed limit (10 meters), an alarm can sound. Finally, U.S. Pat. No. 10,332,375 teaches a system that has two watch-like devices that are in communications. These devices have alarms and proximity sensors as well as a clock, and a heartbeat monitor.

All the devices described above can be used to track children or others within specific distances. These devices use various types of communication including BLUETOOTH and GPS systems. Some of these systems are subject to possible hacking. They are also complicated and may be difficult to adjust and set properly, making them perhaps dangerous.

BRIEF DESCRIPTION OF THE INVENTION

The instant invention overcomes the difficulties described above. This invention is a system that provides an alarm or alert system for those that cannot communicate, or to notify another party when in a situation that needs immediate attention. It consists of a caregiver band and at least one dependent band. An infant dependent band is also included. The caregiver bands have a transceiver that communicates with the dependent bands. The dependent bands have a transceiver as well. The infant dependent band, on the other hand, has only a receiver. The caregiver and dependent bands each have a debossed button that when depressed sends a signal to the dependent band(s) or to the caregiver band. This signal has a loud alarm, a flashing LED light and a vibration. To turn off the alarm, the caregiver can press the debossed button a second time, or a sensor in the bands shuts off the alarm when the bands touch. The debossed button reduces possible false alarms as it is less likely to be accidentally activated.

The system uses radio frequencies so that it is not dependent of an internet source. This product is hearing impaired friendly. When a caregiver band presses the debossed button on the caregiver band, it activates one or more of the dependent band(s) which causes them to alert the dependent and caregiver by LED flashing light, by sound alerts and with light vibration. Once an individual is located, activated dependent band(s) can be deactivated by pressing the debossed button located on the caregiver band, or it will deactivate by internal sensor when bands touch.

It is an object of this invention to provide a personal proximity awareness alert system in which the caregiver Band is the central communicator and communicates by radio frequency transmission to the dependent's band(s).

It is another object of this invention to provide a personal proximity awareness alert system in which the band of the device is made of a material that is 100% waterproof.

It is yet another object of this invention to provide a personal proximity awareness alert system in which a deactivation button is provided to dismiss an alarm once activated.

It is an object of this invention to provide a personal proximity awareness alert system in which an internal sensor deactivates an alarm when bands touch.

It is a further object of this invention to provide a personal proximity awareness alert system in which a speaker system that emits a sounding alarm, and a vibration during the alarm is also provided.

It is another object of this invention to provide a personal proximity awareness alert system in which an alert LED light that flashes in a strobe like fashion when activated, is provided.

It is yet another object of this invention to provide a personal proximity awareness alert system in which a debossed button used to activate radio frequency transmission to initiate an alert in other bands.

DETAILED DESCRIPTION OF THE INVENTION

Figure 1:
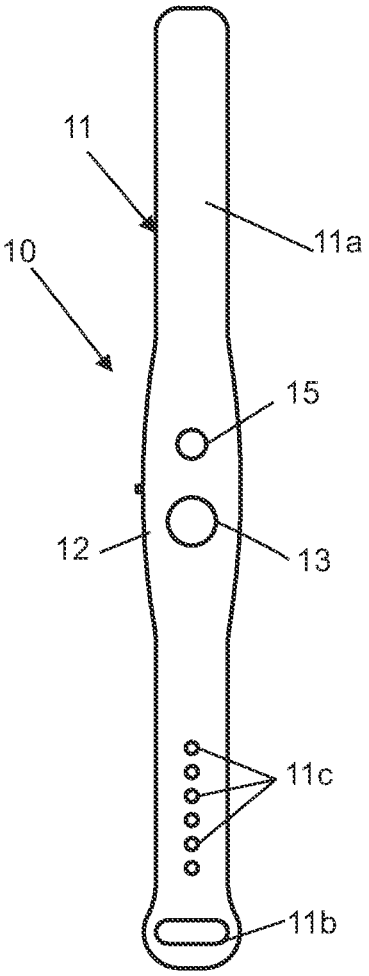
FIG. 1 is a front plan view of the large size caregiver band.

Referring now to the drawings and especially, FIGS. 1-5, details of the large caregiver band are shown. FIG. 1 is a front plan view of the large size caregiver band. In this view, the large caregiver band 10 has a band 11 that has a strap 11*a*, a buckle 11*b* and a number of holes 11*c* used to fit the band 11 (a pin 11*d* (see FIG. 2) is used to secure the band in one of the holes 11*c*). The band 11 is made as silicone, or like material to be 100 percent waterproof.

The caregiver band 10 is the central functioning band of the system. Both the large and small caregiver bands have the same structure (except for size) and operate in the same manner. For the purpose of this application, the term "large" is used to describe a band 11 this is approximately 10 inches in overall length. The case 12 is approximately 2⅞ inches long and approximately 1 inch in width. The term "small" is used to describe a band 11 that is approximately 7 inches long. The case 12 is approximately 1½ inches long and had a width of ⅞ inches wide. Note that the exact sizes may change, but the ratio between the two sizes, large and small, remains the same.

Referring now to figures above, the caregiver band 10 has a case 12. The case includes a radio transceiver 63 (see FIG. 17) that sends out a radio frequency to the corresponding bands to activate an alarm in those bands that a caregiver can then hear to aid in seeking an individual. In addition, an LED light 15 starts flashing in the activated band. The LED light 15 is bright and has a strobe flash that is eye catching to make it easier to locate individual, or to draw attention to individual, especially at night.

The caregiver band also can receive a signal from one or more of the dependent band(s) if the dependent pushes the locate button, as discussed below. If the caregiver band 10 receives a signal from a dependent band 30, it sounds an alarm 64 through a speaker 14 (see FIG. 2) it also has an LED light and a light vibration effect.

The caregiver band is also equipped with a debossed button 13 that when pressed activates a signal to find other bands in the vicinity. Because the button 13 is debossed (see, e. g., FIG. 3), it makes it less likely that it can be activated by mistake.

As discussed below, an internal sensor 61 (see FIG. 17) deactivates the alarm if the two bands that are active, touch.

Figure 2:
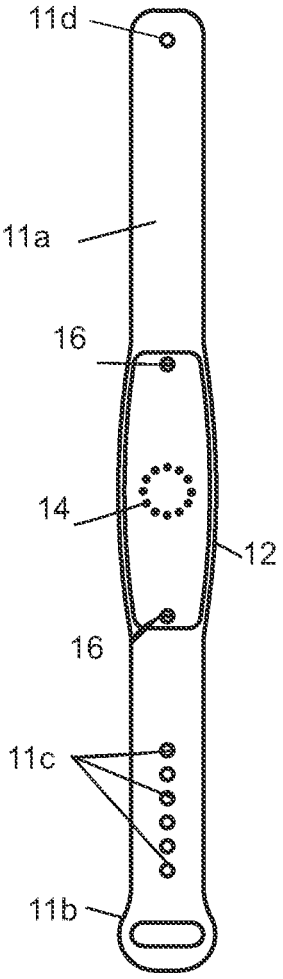
FIG. 2 is a rear plan view of the large size caregiver band.

As shown on FIG. 2, the speaker 14 on the caregiver band 10 is on the inner part of the band FIG. 2 is a rear view). By placing the speaker on the back of the caregiver band, it is quieter than the alarms on the dependent band 30 and the infant band 40. FIG. 2 also shows the screws 16 that are used to access the interior of the case 12. That allows a user to change the battery 62 (see FIG. 17 as needed. Finally, FIG. 2 shows a pin 11*d*. This pin is used to secure the band 11 by fitting into one of the holes 11*c*.

Figure 3:
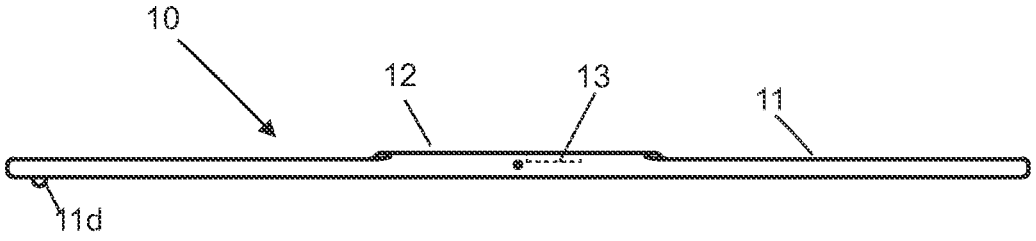
FIG. 3 is a side view of the large size caregiver band.

FIG. 3 is a side view of the large size caregiver band. Note the button 13 is debossed below the top of the case 12, as shown.

Figure 4:
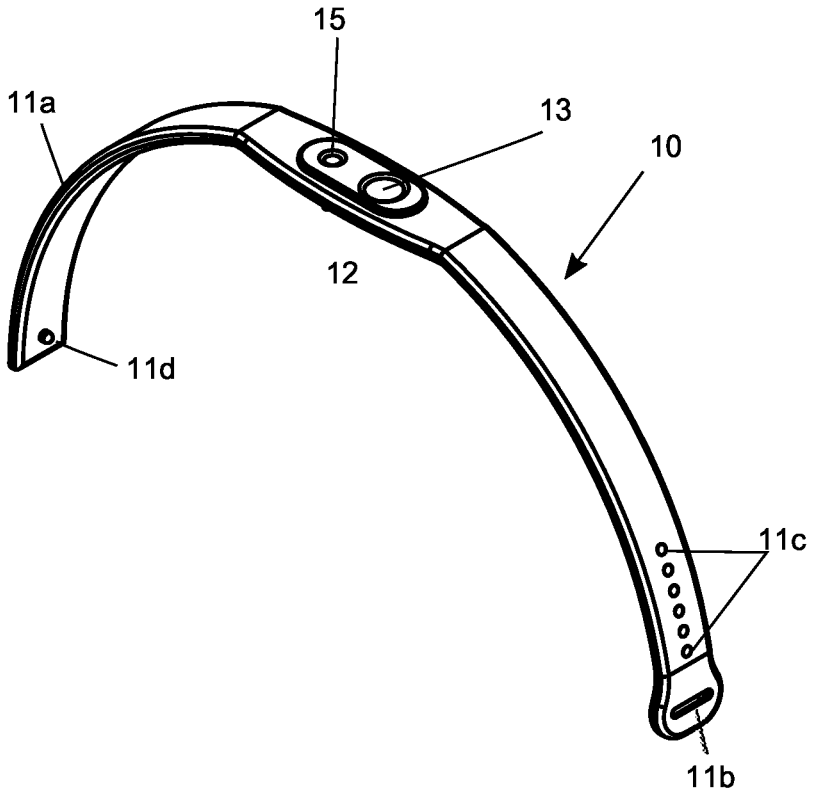
FIG. 4 is a perspective view of the large size caregiver band.

FIG. 4 is a perspective view of the large size caregiver band 10. In this view, the strap 11*a*, the buckle 11*b* and the holes 11*c* are shown. Also note the pin 11*d* is shown. Also note the case 12, the debossed button 13 and the light 15.

Figure 5:
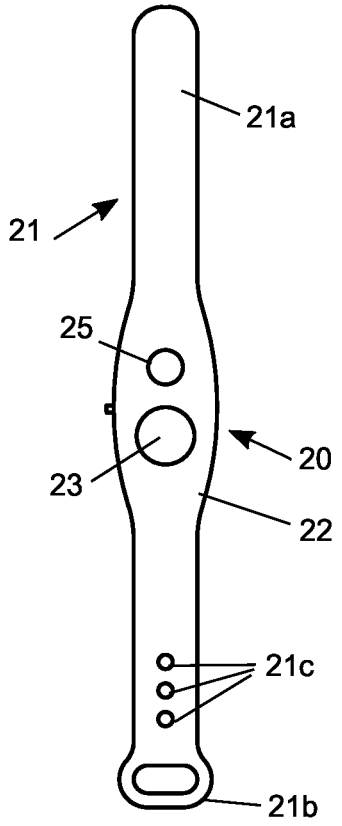
FIG. 5 is a front plan view of the small size caregiver band.

FIG. 5 is a front plan view of the small size caregiver band 20. Although smaller in size, it has the same features as the large caregiver band 10. The band 21 has a strap 21*a*, a buckle 21*b*, holes 21*c*, the case 22, the debossed button 23, and the light 25.

Figure 6:
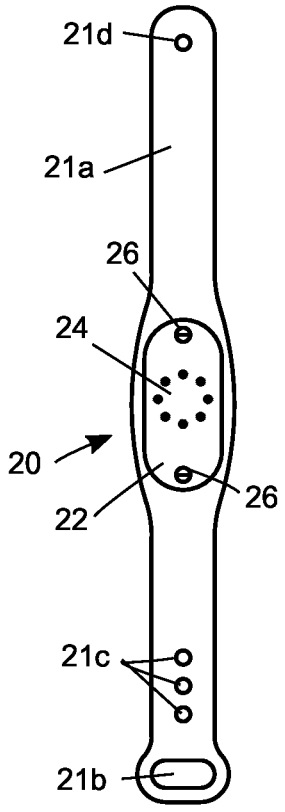
FIG. 6 is a rear plan view of the small size caregiver band.

FIG. 6 is a rear plan view of the small size caregiver band 20 that shows the speaker 24, the pin 21*d* and the screws 26.

Figure 7:
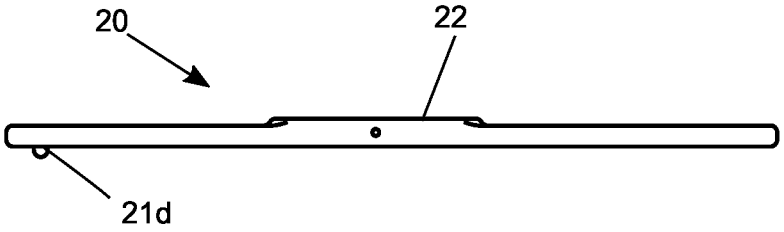
FIG. 7 is a side view of the small size caregiver band.

FIG. 7 is a side view of the small size caregiver band 20, showing the case 22 and the pin 21*d*.

Figure 8:
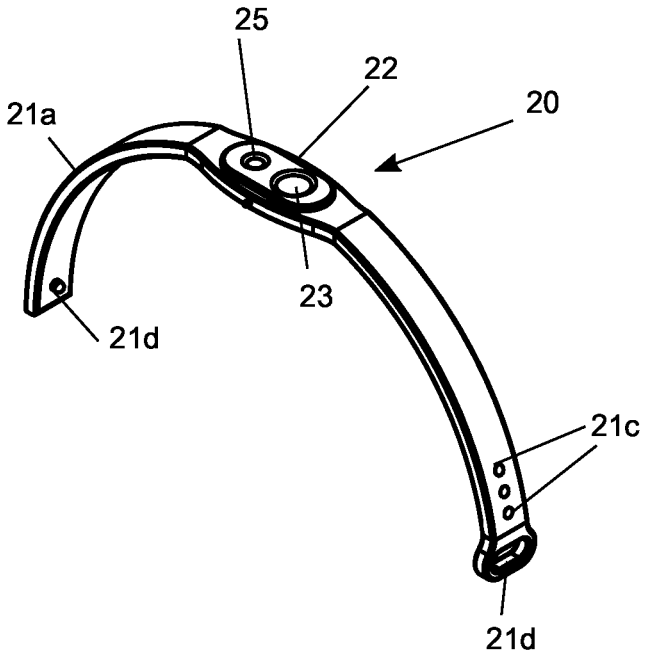
FIG. 8 is a perspective view of the small caregiver band.

FIG. 8 is a perspective view of the small caregiver band. As before, in this view, the strap 21*a*, the buckle 11*b* and the holes 21*c* are shown. Also note the pin 21*d* is shown. Also note the case 22, the debossed button 23 and the light 25.

The caregiver band 10 also sends a communication signal to both dependent band 30, and infant dependent band 50 (see FIG. 18) to sound an alarm, lightly vibrate the band, and to cause an LED light to start flashing on the receiving band, as discussed below. The LED light is bright and has a consistent strobe flash that will be catching to the eye, which makes it easier to locate or to draw attention to an individual.

The communication occurs when the debossed button (13 or 23) is intentionally pressed on the caregiver band. The button (13 or 23) causes the internal radio transceiver 50 (see FIG. 17) to send radio frequency to the dependent band or infant dependent band.

Figure 9:
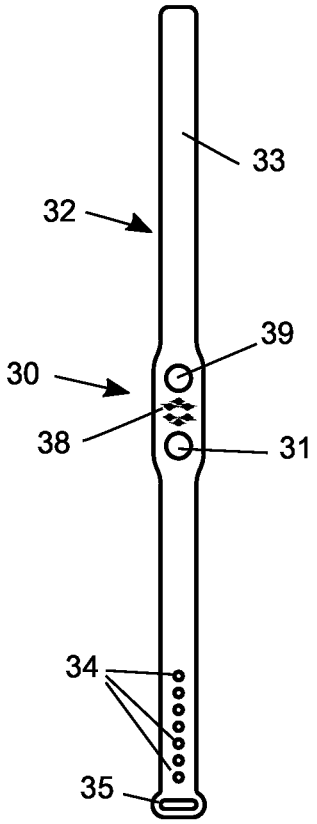
FIG. 9 is a front plan view of the dependent band.

FIG. 9 is a front plan view of the dependent band 30, which can be used for a child or a vulnerable adult. It communicates with a caregiver band by a transceiver 37 (similar to 50 shown in FIG. 17) that is activated by a debossed button 31.

Figure 17:
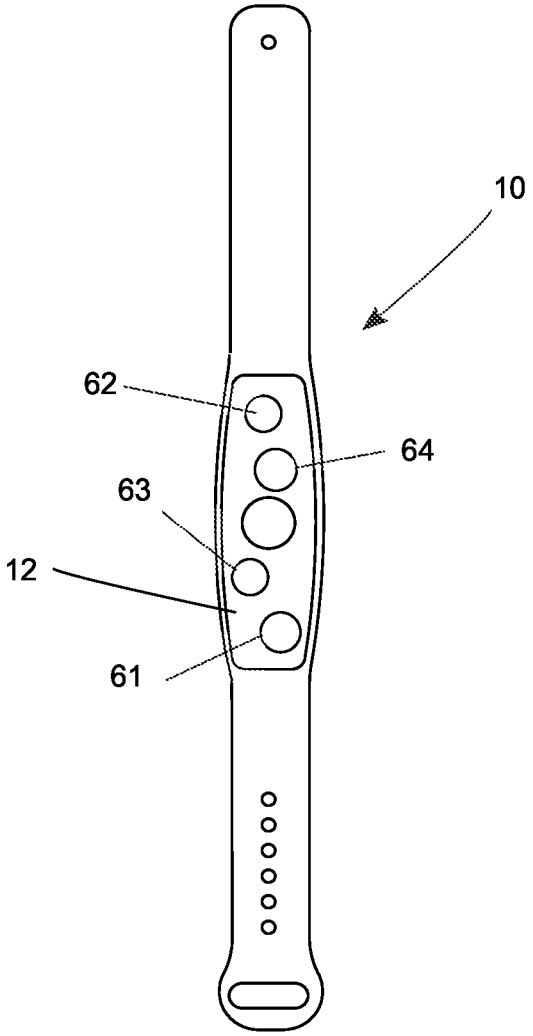
FIG. 17 is a cutaway front plan view of the large size caregiver band showing the internal components.

As before, the band 32 is made of silicone or like material to be 100% waterproof. It has a strap 33, holes 34, pin 34*a* and buckle 35 as in the caregiver bands. Like the caregiver bands, the dependent band is equipped internal sensor 40 similar to that (shown in FIG. 17 as 51) of the caregiver bands that will detect when the caregiver band is touching it to deactivate the alarm. The alarm can also be deactivated by a signal from a caregiver band. The dependent band 30 also has a speaker 38 located on the top outside of the band, unlike the caregiver band, so that sound can be clearly heard from a distance. The alarm 41 (similar to 64 that is shown in FIG. 17) is loud, but not deafening. Additionally, the dependent band lightly vibrates and an LED light 39 also starts flashing when a signal is received. As before, the LED light 39 is bright and has a consistent strobe flash that is eye catching to make it easier to locate or to draw attention to the individual.

Figure 10:
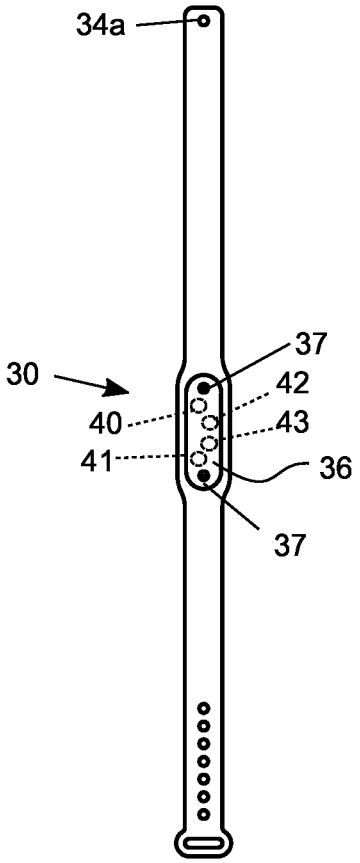
FIG. 10 is a rear plan view of the dependent band.

FIG. 10 is a rear plan view of the dependent band 30. Here, the back panel 36 with screws 37 is shown. The back panel 36 allows access to the sensor 40, alarm 41, battery 42, and transceiver 43 (all shown in dashed lines).

Figure 11:
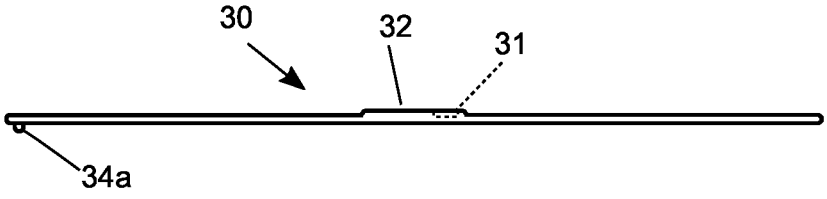
FIG. 11 is a side view of the dependent band.

FIG. 11 is a side view of the dependent band 30 showing that the debossed button 31 is clearly below the surface of the band.

Figure 12:
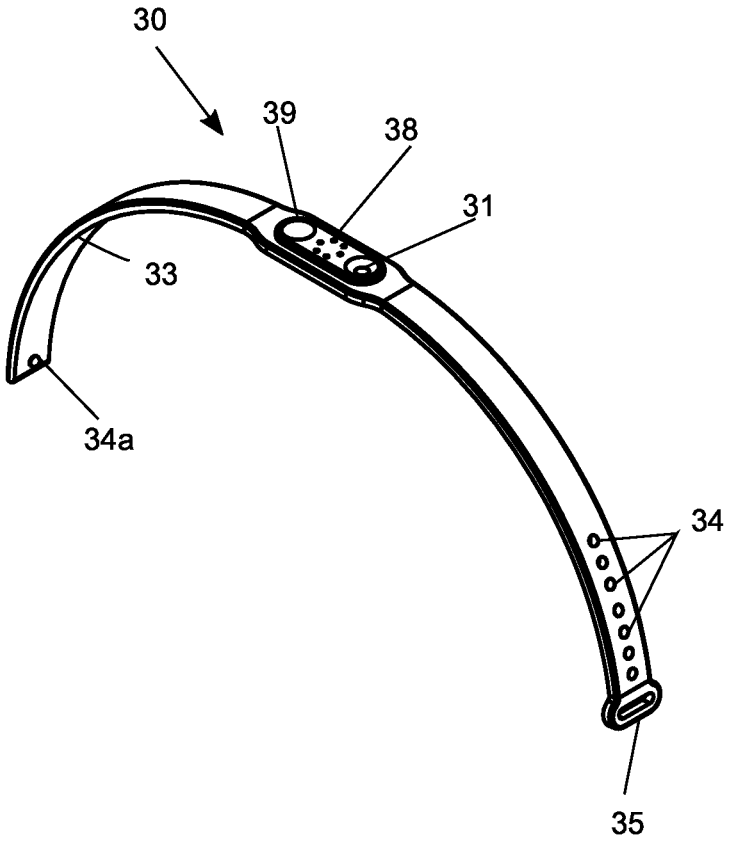
FIG. 12 is a perspective view of the dependent band.

FIG. 12 is a perspective view of the dependent band 30 showing the debossed button 31, the band 32, the strap 33, the holes 34 and buckle 35. Also shown are the speaker 38 and the LED light 39.

Figure 13:
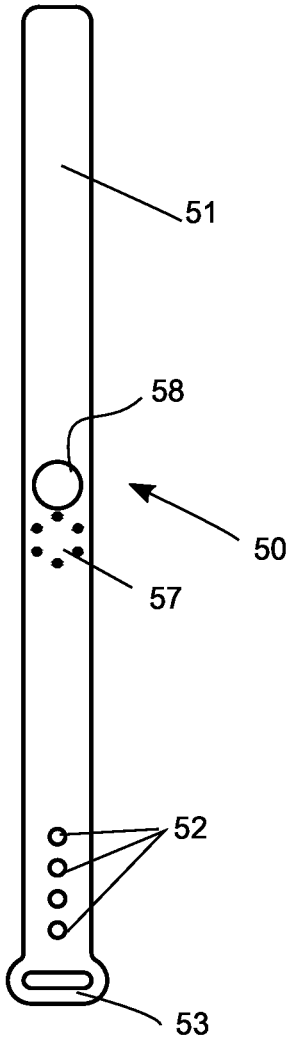
FIG. 13 is a front plan view of the infant dependent band.

FIG. 13 is a front plan view of the infant dependent band 50. As before, this band has a strap 51, holes 52, buckle 53 and stud 54 as in the caregiver bands. The band 50, like the other bands, is made of silicone or like material to be 100 percent waterproof. The infant dependent band 50 is equipped internal sensor 55 (FIG. 14 in dashed lines) that will detect when the caregiver band is touching it to deactivate an alarm 56. The alarm 56 can also be deactivated by radio frequency transmission from a caregiver band 10. The speaker 57 on this band is located on the outside of the band to emit sound clearly. Once a radio frequency transmission has been received from a caregiver band 10, it will sound a loud, but not deafening alarm, and lightly vibrate. An LED light 58 will also start flashing. The LED light 58 is bright and has a consistent strobe flash that will be eye catching to make it easier to locate individual, or to draw attention to individual.

Figure 14:
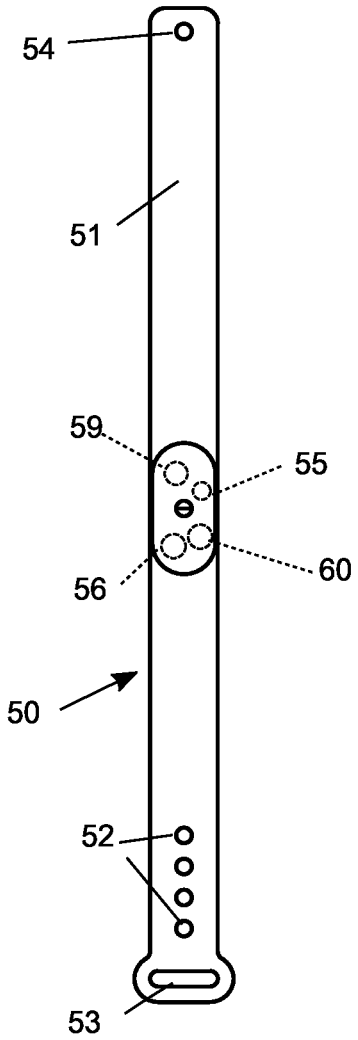
FIG. 14 is a rear plan view of the infant dependent band.

FIG. 14 is a back view of the infant dependent band 50. In this view, the internal sensor 55 and alarm 56 are shown, as well as the radio receiver 59 and battery 60.

Figure 15:
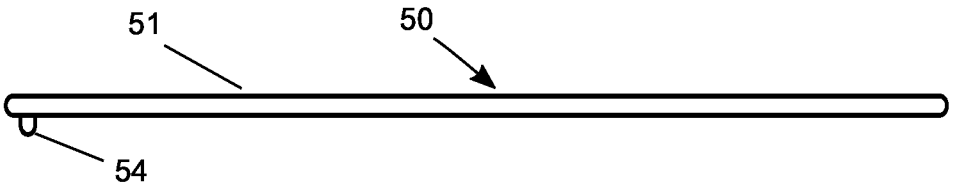
FIG. 15 is a side view of the infant dependent band.

FIG. 15 is a side view of the infant dependent band 50. Here, the band 51 is shown.

Figure 16:
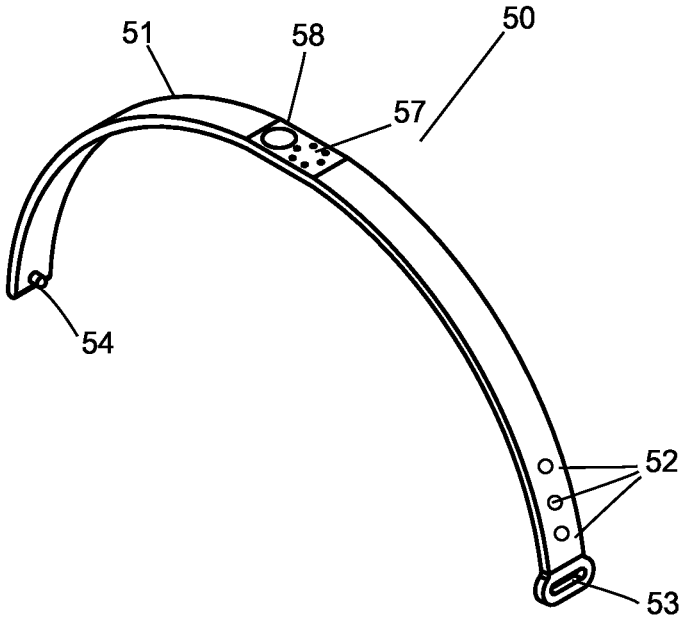
FIG. 16 is a perspective view of the infant dependent band.

FIG. 16 is a perspective view of the infant dependent band 50. In this view, the strap 51, the holes 52, buckle 53 and stud 54 are shown along with the speaker 57 and the LED light 58.

FIG. 17 is a cutaway front plan view of the large size caregiver band showing the internal components. Here, the inside of the case is shown. Note that the small caregiver band and the dependent band have the same components. The infant dependent band has similar, but not identical, components, as discussed above. Note too that the components shown are representations and not necessarily located in any specific place within the case. Other arrangements are possible. For example, it is possible to combine the sensor, transceiver and alarm on a single circuit board. As shown, the sensor 61, the battery 62, the transceiver 63, and alarm 64, are shown installed within the case of the large dependent band 10.

Figure 18:
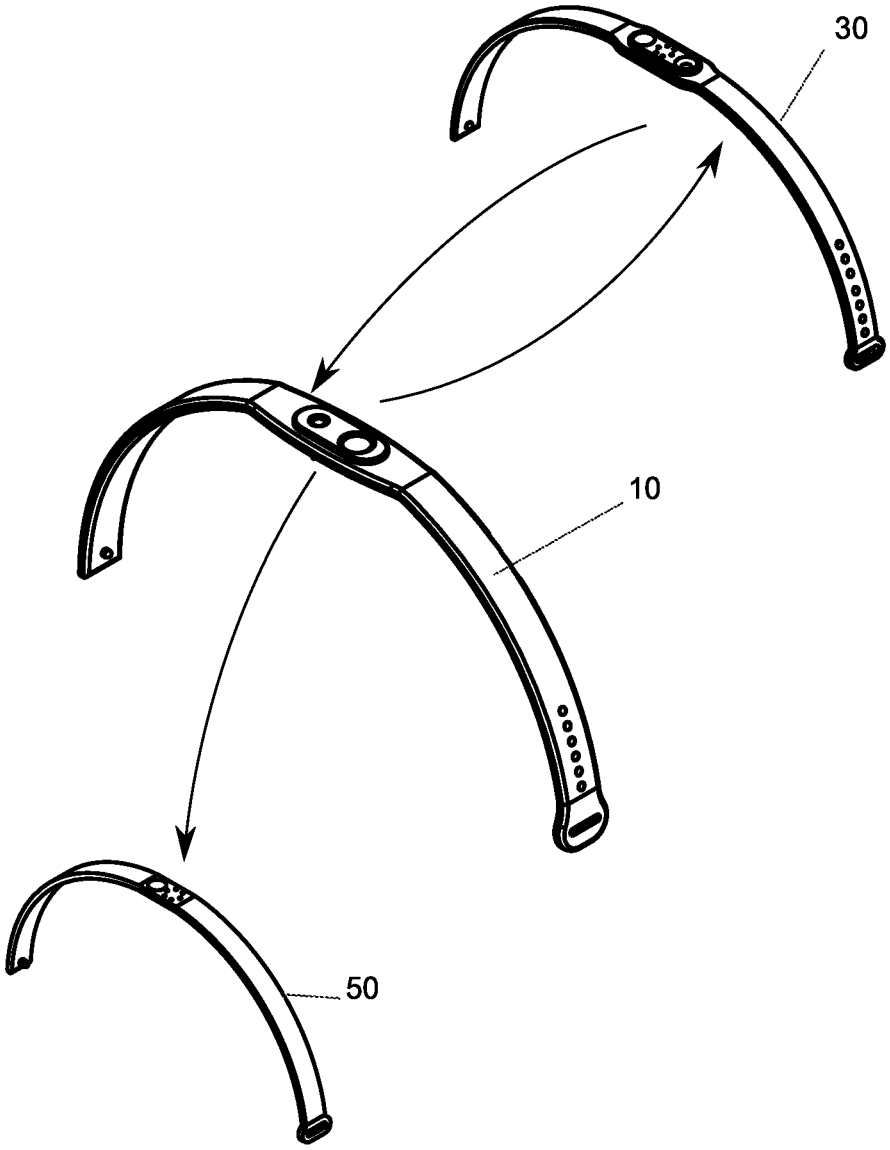
FIG. 18 is a detail view showing the large caregiver band, the dependent band, and the infant dependent band communicating.

FIG. 18 is a detail view showing the large caregiver band 10, the dependent band 30, and the infant dependent band 50 communicating. Note that two-way communication (indicated by the arrows) is possible between the large caregiver band 10 and the dependent band 30 and that only one-way communication is possible (indicated by the single arrow from the large caregiver band 10, to the infant dependent band 50) between the large caregiver band 10 and the infant dependent band 50.

Figure 19:
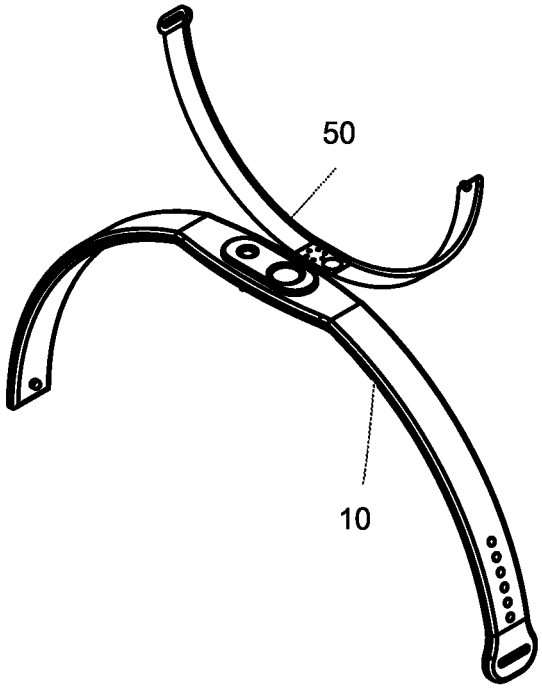
FIG. 19 is a detail view showing activation of the internal sensor that deactivates the alarm when bands touch.

FIG. 19 is a detail view showing activation of the internal sensor that deactivates the alarm when bands touch. As shown, when a caregiver band 10 touches a dependent band or an infant dependent band 50 (shown here), the internal sensors (61 in the caregiver band (FIG. 17) and 55 in the infant dependent band (FIG. 14)) turn off the alarms.

Figure 20:
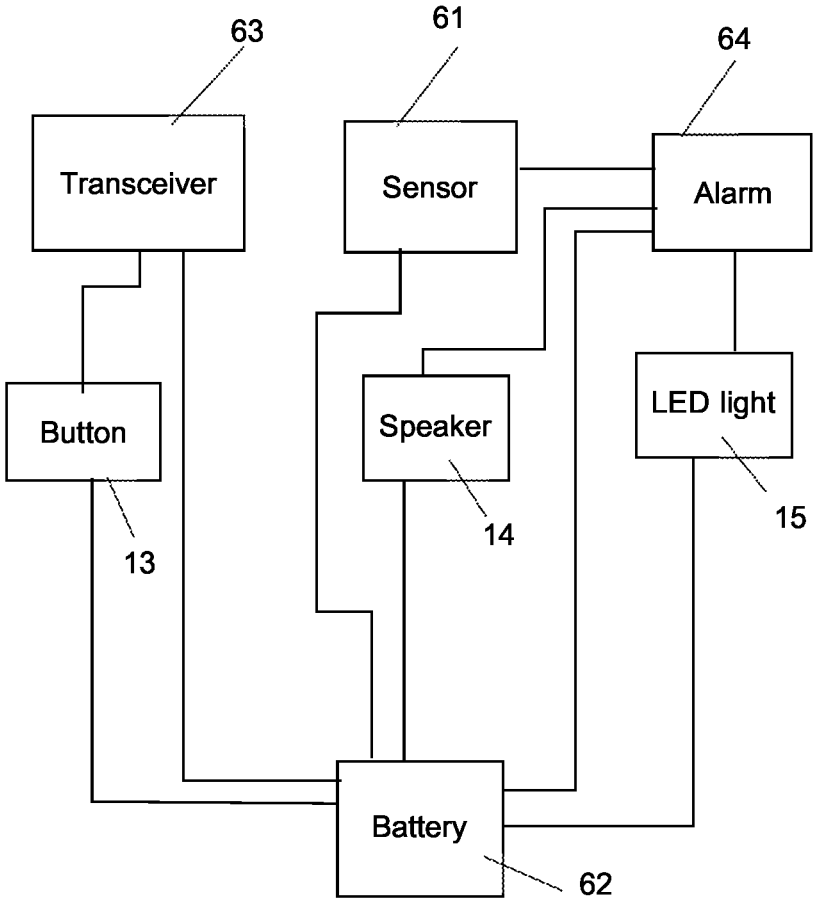
FIG. 20 is a block diagram of the caregiver band.

FIG. 20 is a block diagram of the caregiver bands 10 and 20. This figure shows the transceiver 63, sensor 61 and alarm 64 as well as the debossed button 13, the speaker 14 and the LED light 15 all being connected to the battery 62.

Figure 20A:
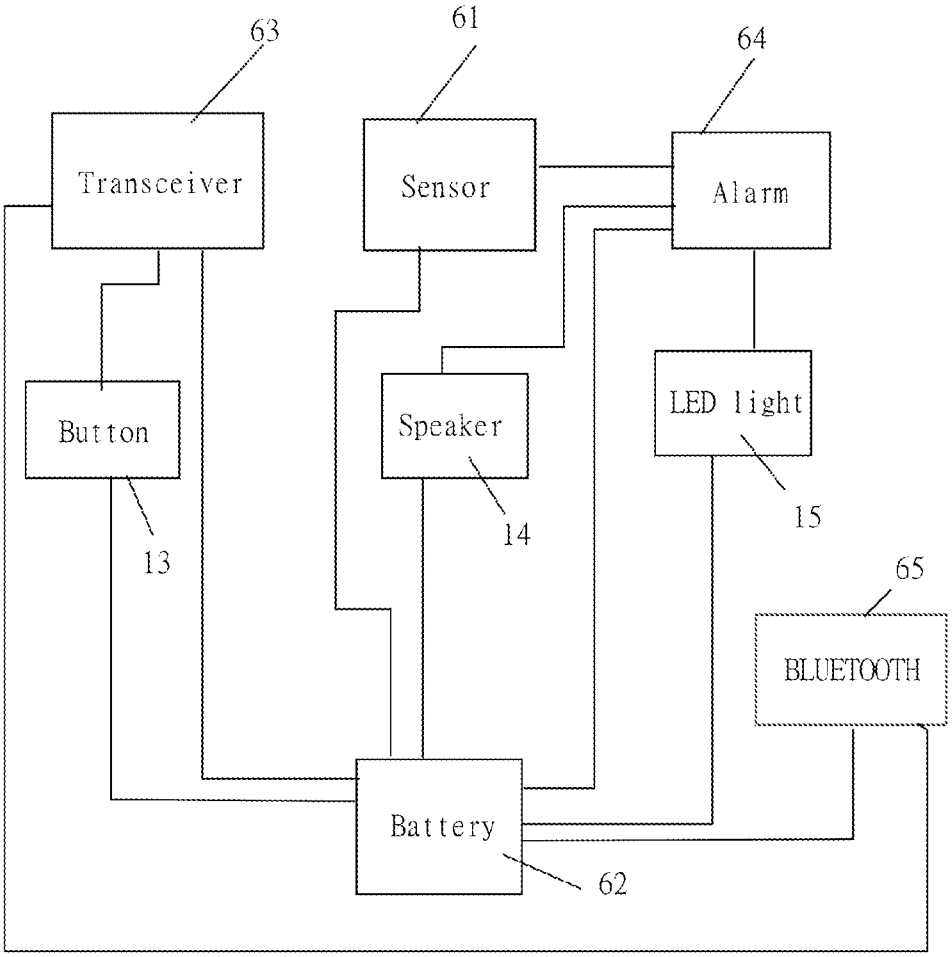
FIG. 20*a* is a block diagram of the caregiver band showing a BLUETOOTH® component.

FIG. 20*a* is a block diagram of the caregiver bands 10 and 20. This figure shows the transceiver 63, sensor 61 and alarm 64 as well as the debossed button 13, the speaker 14 and the LED light 15 all being connected to the battery 62. It also shows a BLUETOOTH® transceiver 65 that connects to the battery 62 as well as the signal and alarm circuits of the band. This embodiment is used with the app system discussed below.

Figure 21:
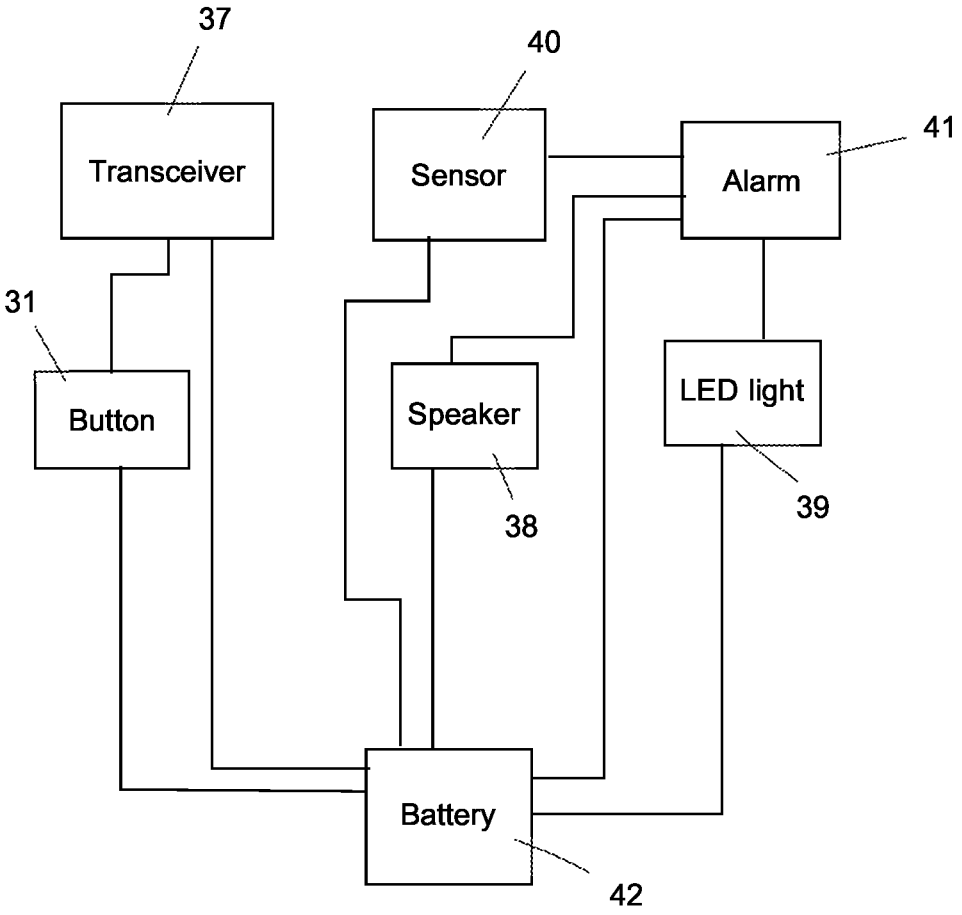
FIG. 21 is a block diagram of the dependent band.

FIG. 21 is a block diagram of the dependent band 30. Note that the dependent band 30 has the same components as that of the caregiver bands, but in a smaller package. FIG. 21 shows the transceiver 37, sensor 40 and alarm 41 as well as the debossed button 31, the speaker 38 and the LED light 39 all being connected to the battery 40.

Figure 22:
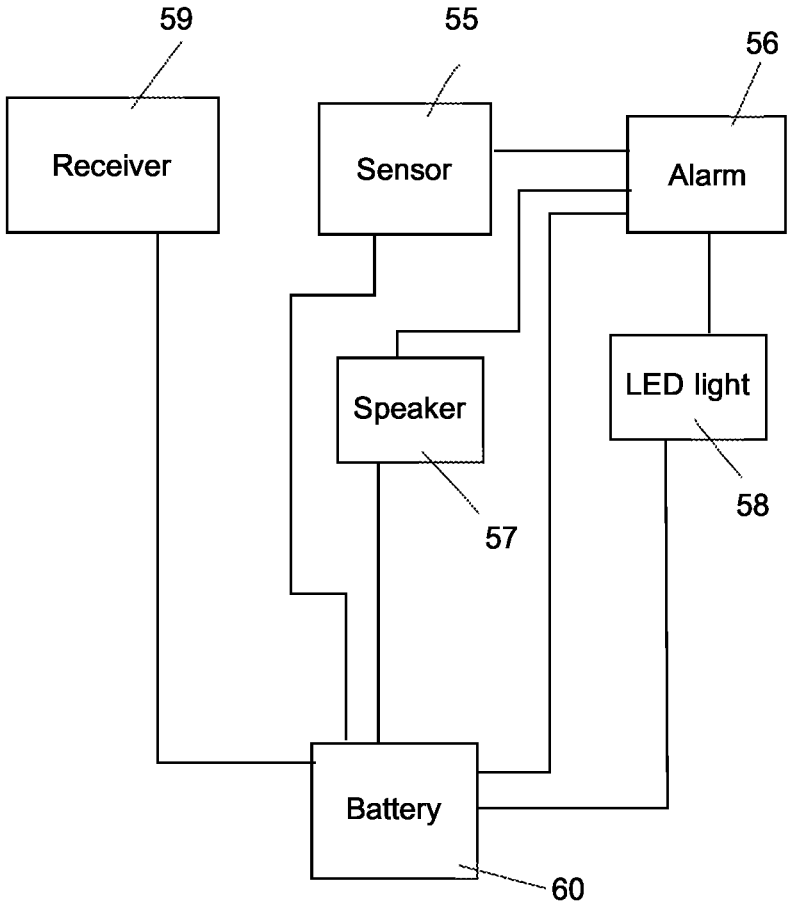
FIG. 22 is a block diagram of the infant dependent band.

FIG. 22 is a block diagram of the infant dependent band 50. This figure shows the main difference between the other bands and the infant band. The infant band does not have a debossed button and instead of a transceiver, there is only a radio receiver, 59, which limits communication to one-way only. The infant dependent band 50 does have the other components: sensor 55 and alarm 56 a speaker 57, and the LED light 58 all being supplied by the battery 60.

The devices can stand alone as the system described above. However, an application (app) for a smartphone can also be used. This app connects to all bands. Note that the app is not the preferred embodiment. Although it is convenient for some users to use a smartphone, the app requires connections with BLUETOOTH® (see FIG. 20*a*), which is subject to hacks and is not as secure as the radio used in the preferred embodiment. That said, the app system is described below.

Figure 23:
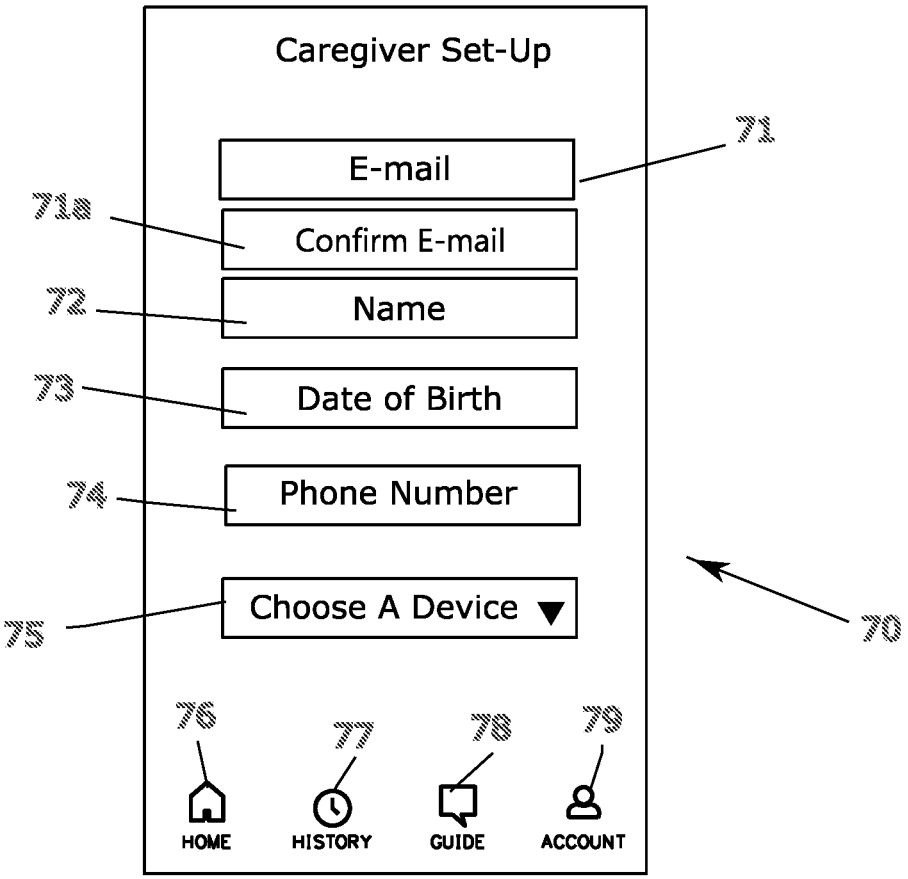
FIG. 23 is a screen shot of the set-up page for the caregiver.

FIG. 23 is a screen shot of the set-up page for the caregiver. In this view, the screen 70 has a set of blocks to fill out basic information for the caregiver. These blocks include the caregiver's e-mail 71, a confirm e-mail block 71*a*, the caregiver's name 72, the caregiver's date of birth 73, the caregivers phone number 74, and a block entitled "choose a device" 75. This block is a pulldown menu in which the caregiver can select the caregiver's band. Note that the bottom of the screen contains four icons that are visible on all of the app's screens. They are: home 76, history 77, guide (a user's help function) 78, and account 79.

Figure 24:
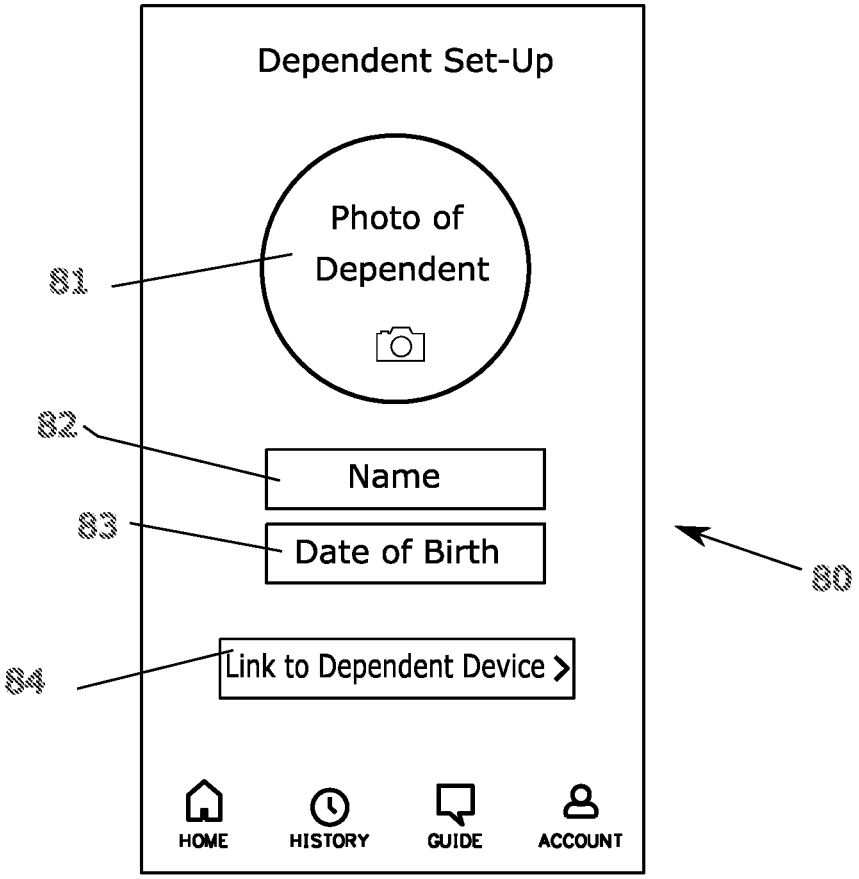
FIG. 24 is a screen shot of the set-up page for a dependent profile.

FIG. 24 is a screen shot of the set-up page for a dependent profile 80. On this screen, there is a circle 81 at the top of the page, which allows the user to take and add a photo of the particular dependent. Below that is a block 82 for the dependent's name, a block 83 for the dependent's date of birth, and a block 84 that acts as a link that ties the app to the particular dependent's device.

Figure 25:
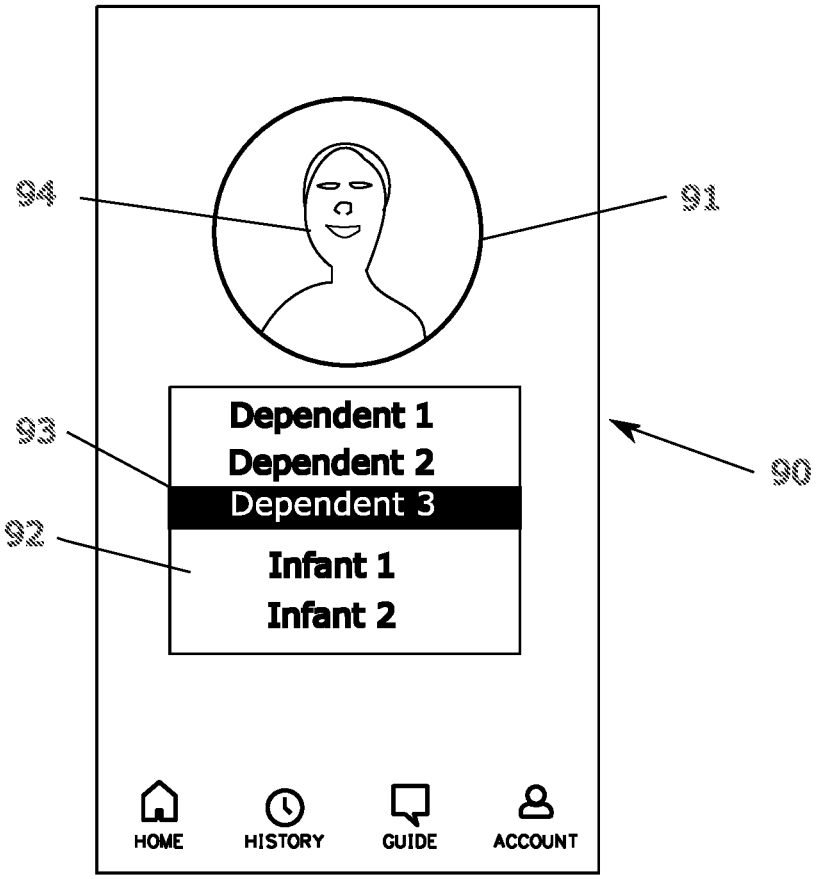
FIG. 25 is a screen shot of the app showing the selector menu for more than one dependent.

FIG. 25 is a screen shot 90 of the app showing the selector menu for more than one dependent. In this figure, the screen shows a photo 91 of the dependent at the top. This photo changes as the user scrolls through the list 92 shown below the photo. The list shows the various dependents (including infants). As the user scrolls over the list, the text 93 changes to highlight the selection. Again, the photo of the person 94 matches the person highlighted. Once the desired dependent is selected, the screen changes to that shown in FIG. 26.

Figure 26:
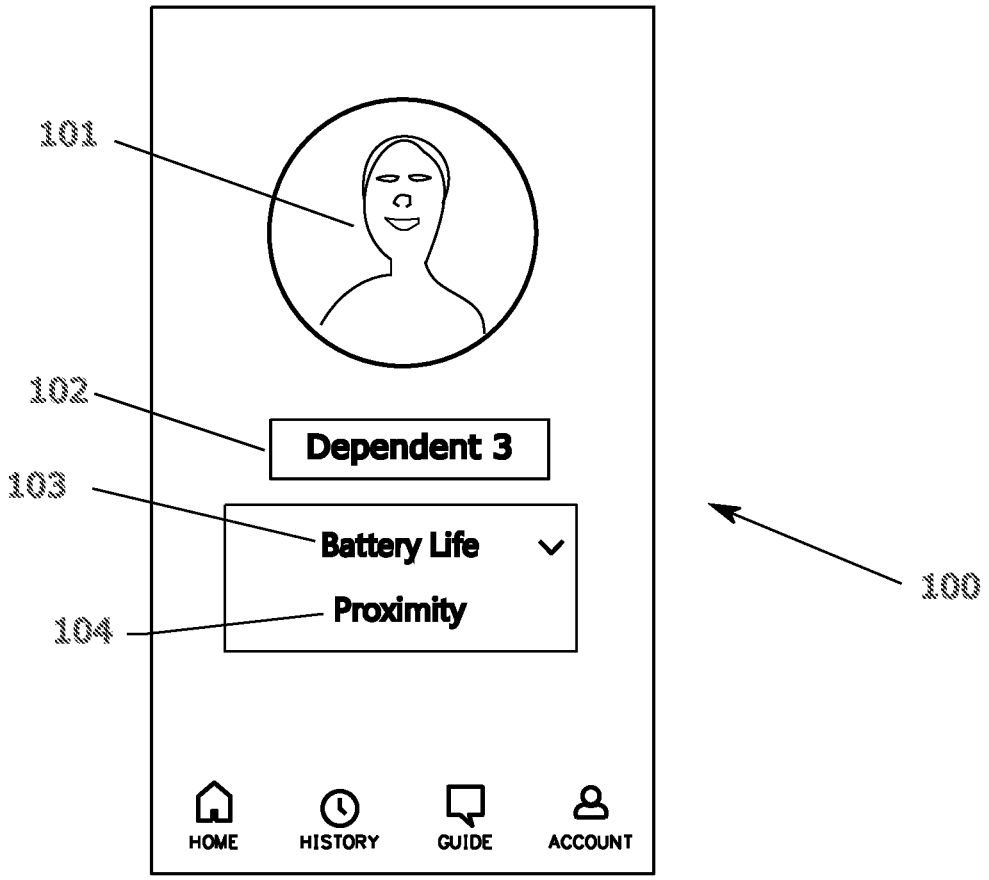
FIG. 26 is a screen shot of the app showing the basic, non-alarm screen.

FIG. 26 is a screen shot 100 of the app showing the basic, non-alarm screen. Here, the chosen dependent's photo 101 is shown at the top. Below that is the person's designation 102. Below that is a pulldown menu that can display the battery life 103 of the dependent's band or the proximity 104 of the dependent to the user.

Figure 27:
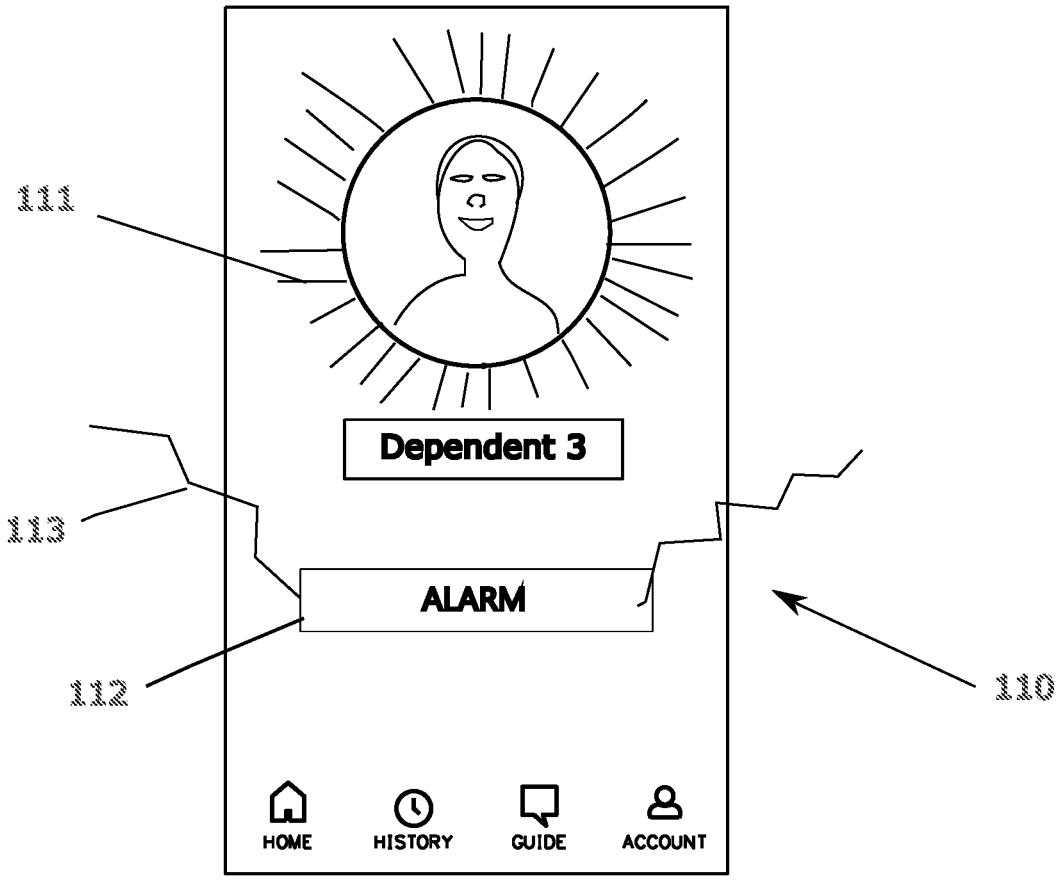
FIG. 27 is a screen shot of the app showing the alarm screen.

FIG. 27 is a screen shot 110 of the app showing the alarm screen. If the user or dependent activates the alarm function of the band, The screen around the dependent's photo 111 pulsates with a light. The word "ALARM" appears in the status window 112 and an audible alarm sounds 113 as represented by the lines as shown.

Note that each band has a BLUETOOTH® wireless communication system installed on the version in which the app can be used.

Although the app can be used in conjunction with a caregiver band, it is designed to be used primarily by those who do not have a caregiver band and who are asked to monitor one or more dependents. This user can quickly download the app and set it up so that the monitoring can be done without a caregiver band.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A personal proximity awareness alert system comprising:

a) a caregiver band said caregiver band having a case, said case having a front and a rear and an inside, and a strap, said case of said caregiver band containing i) a transceiver, ii) an alarm;

iii) an LED light;

iv) a battery; and v) a speaker, said speaker mounted on the rear of the inside of said caregiver band; said case further including a debossed button; and b) at least one dependent band having a case having a front, a rear and an inside, and a strap, said case of said dependent band containing i) a transceiver;

ii) an alarm;

iii) an LED light;

iv) a battery; and v) a speaker, mounted to the front of the inside of said case; said case further including a debossed button;

c) a sensor installed in said case of said caregiver band for sensing contact with a dependent band;

d) whereby when said debossed button on said caregiver band is depressed, said alarm and said LED light on said dependent band are activated;

e) and further, when said debossed button on said dependent band is depressed, said alarm and said LED light on said caregiver band are activated.

2. The personal proximity awareness alert system of claim 1, further including:

an infant dependent band having a case and a band, said case of said dependent band containing a radio receiver; an alarm; an LED light; a battery; and a speaker.

3. The personal proximity awareness alert system of claim 2, further including a sensor installed in said case of said caregiver band and said infant dependent band for sensing contact with an infant dependent band.

4. The personal proximity awareness alert system of claim 1 wherein said caregiver band is about 10 inches in length, and the case is about 2⅞ inches long and about 1 inch wide.

5. The personal proximity awareness alert system of claim 1 wherein said caregiver band is about 7 inches long, and the case is about 1½ inches long and about ⅞ inches wide.

6. The personal proximity awareness alert system of claim 2 wherein said caregiver, dependent and infant dependent bands contain a vibrator mechanism.

7. The personal proximity awareness alert system of claim 1 further comprising an app for a smartphone including:

a) a set-up page for the caregiver;

b) a set-up page for at least one dependent;

c) a selector menu for selecting one dependent from a list including said at least one dependent;

d) a non-alarm screen; and e) an alarm screen.

8. The personal proximity awareness 5 alert system of claim 2 further comprising an app for a smartphone including:

a) a set-up page for the caregiver;

b) a set-up page for at least one dependent;

c) a selector menu for selecting one dependent from a list including said at least one dependent;

d) a non-alarm screen; and e) an alarm screen.

9. The personal proximity awareness alert system of claim 7 wherein the non-alarm screen further comprises:

a) a display of a dependent's photo;

b) a designator for said dependent; and c) a pulldown menu, said pulldown menu including at least one status display.

10. The personal proximity awareness alert system of claim 8 wherein the non-alarm screen further comprises:

a) a display of a dependent's photo;

b) a designator for said dependent; and c) a pulldown menu, said pulldown menu including at least one status display.

11. The personal proximity awareness alert system of claim 9 wherein said at least one status display includes:

i) a display of the battery life of the battery in said dependent's band; and ii) a measure of the proximity of the dependent to the user.

12. The personal proximity awareness alert system of claim 10 wherein said at least one status display includes:

i) a display of the battery life of the battery in said dependent's band; and ii) a measure of the proximity of the dependent to the user.

13. The personal proximity awareness alert system of claim 7 wherein the alarm screen further comprises:

a) a pulsating light on the dependent's photo;

b) a status window having the word ALARM displayed therein; and c) an audible alarm sound emanating from said smartphone.

14. The personal proximity awareness alert system of claim 8 wherein the alarm screen further comprises:

a) a pulsating light on the dependent's photo;

b) a status window having the word ALARM displayed therein; and c) an audible alarm sound emanating from said smartphone.

* * * * *